United States Patent [19]

Hurst

[11] 4,282,614

[45] Aug. 11, 1981

[54] TABLE FOR USE WITH END-FOR-END ROTATABLE HOSPITAL BED

[76] Inventor: Howard B. Hurst, 122 Carlie Rd., Lynnfield, Wilmington, Del. 19803

[21] Appl. No.: 94,829

[22] Filed: Nov. 16, 1979

[51] Int. Cl.[3] ..... A61G 7/10

[52] U.S. Cl. ..... 5/507; 5/67

[58] Field of Search ..... 5/60, 61, 62, 67, 68, 5/507, 508; 248/345.1

[56] References Cited

U.S. PATENT DOCUMENTS

| | | | |
|---|---|---|---|
| 1,134,720 | 4/1915 | Bradley | 5/507 |
| 2,709,818 | 6/1955 | Freese | 5/507 |
| 3,034,152 | 5/1962 | Stryker | 5/67 |
| 3,266,061 | 8/1966 | Fuschsel | 5/60 |
| 3,832,742 | 9/1974 | Stryker | 5/62 |
| 3,869,106 | 3/1975 | Gregov | 248/345.1 |

*Primary Examiner*—Casmir A. Nunberg
*Attorney, Agent, or Firm*—Mortenson & Uebler

[57] ABSTRACT

An improved table is provided for use with an end-to-end rotatable hospital bed. Such beds are rotatable upon a pair of circular and spaced rails. The table of this invention is infinitely adjustable on such bed and can be fixed in any position for use by a patient regardless of the patient's position on the bed. The table comprises a table surface and four telescoping support members, one support member extending from each of the four corners of the table. The support members are adjustably affixed at one end near the corners of the table and have adjustable clamps at the other end thereof, which clamps can be adjustably affixed to the bed rails or the supporting bars of the bed, as desired, to afford a useful table for the patient.

8 Claims, 6 Drawing Figures

TABLE FOR USE WITH END-FOR-END ROTATABLE HOSPITAL BED

BACKGROUND OF THE INVENTION

This invention relates to improvements in a table for a hospital bed rotatable upon circular, rotatable side rails enabling end-for-end rotation of a patient supported on the bed.

Prior tables for such beds have been separate units mounted upon wheels such as those in common use in hospitals for patients in ordinary hospital beds. Such tables have drawbacks in use with rotatable beds, and often cannot be used at all when the patient is placed in an awkward position.

U.S. Pat. No. 3,034,152 describes a rotatable hospital bed generally of the type for which the table of this invention is a useful component. It is clear that the present table can be used with other bed constructions of more or less similar type. The rotatable bed includes a pair of spaced circular and coaxial rails or rings arranged in vertical planes and connected to each other by cross support members. The rails are supported upon a wheeled base for rotation about their common axis. Framing extends across and between the rails to support a mattress platform and mattress which normally engages a patient's back.

Anterior and posterior framing is disclosed, the anterior frame being moveable toward and away from the posterior frame. The anterior frame may be adjusted so that the patient can be held snugly between the two frames during rotation of the rails whereby the posterior and anterior frames are rotated through approximately 180° and the patient is moved from a face down position to a face up position, or the reverse. Such a bed is useful where, for example, the patient is in traction or requires treatment which necessitates frequent changing of the patient's position.

The primary objective of the present invention is to provide an improved table for use with a rotatable hospital bed as described, which table is infinitely adjustable on such bed and can be fixed in any position for use by a patient regardless of the patient's position on the bed.

SUMMARY OF THE INVENTION

An improved table for use with a rotatable bed is provided. The rotatable bed contemplated is one generally having two circular rails and supporting structure to support a mattress platform, mattress and patient, all supported on a wheeled supporting platform and all rotatable on the rails providing for 180° rotation of the patient on the mattress.

The table of this invention is adaptable to be fixed in virtually any position for use by the patient regardless of the patient's position on the rotatable bed. The table includes a table surface, which may be of wood or plastic or other suitable material and four telescoping support members, one support member extending from each of the four corners of the table. These support members are adjustably affixed at one end near the corners of the table and have adjustable clamping means at the other end thereof, which clamping means can be adjustably affixed to the bed rails or the supporting bars of the bed, as desired, to afford a table for use by the patient.

Preferably, the table of this invention has a table surface, generally rectangular or square, with side and back boards attached perpendicular to the surface at the sides and back thereof, extending around three sides of the table surface and extending above and below the table surface to prevent objects from falling from the table.

A ledge can be placed on at least one side of the table surface to hold a book or the like if desired.

The edge of the table adjacent the patient is preferably covered with plastic and has an indentation facing the patient for ease of access to objects on the table by the patient.

The telescoping support members are preferably made of aluminum tubing, although it is clear that many other suitable materials could be used. Preferably each support member comprises an inner tube and an outer sleeve, and means for fixing the position of the inner tube with respect to the outer sleeve. A bolt and nut extending through holes in the inner tube and outer sleeve may be used to fix the position of the inner tube and sleeve at the desired telescope position.

Each support member is affixed at one end thereof to the table surface near one corner thereof by adjustable securing knobs secured to the support and table by means such as carriage bolts, for example.

Each support member is affixed at the other end thereof to a desired position on either the bed rails or supporting members by clamping means. Preferably the clamping means comprise a shaped bracket which extends around the rail at one end and is adapted to receive a set screw at the other end, the set screw providing means for securing the clamp to the railing or support bar, each clamp being affixed to a respective support member preferably by a carriage bolt extending through the support member and into a tapped and threaded hole in the shaped bracket and being secured thereat.

DETAILED DESCRIPTION OF THE INVENTION WITH REFERENCE TO THE DRAWINGS

Figure 1:
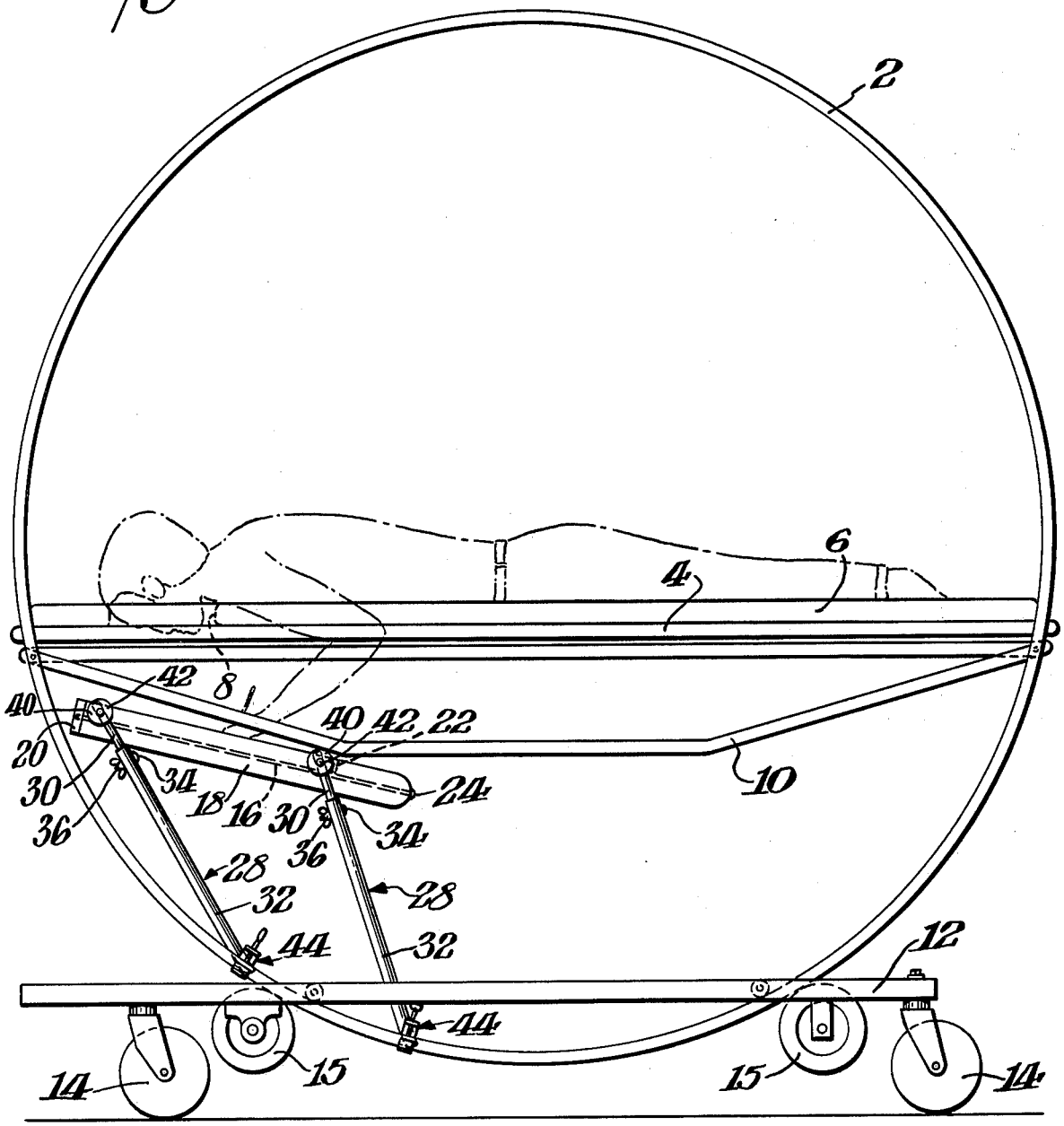
FIG. 1 is a side elevational view of the table of this invention mounted on a rotatable hospital bed in such a way to enable a patient lying upon his stomach to use the table.

This invention may be better understood by reference to the accompanying drawings of which FIG. 1 is an elevational view of the table of this invention secured to a rotatable hospital bed such that a patient lying on his stomach can utilize the table for reading, writing and the like. The bed rails 2 support mattress platform 4 upon which mattress 6 is located and upon which the patient reclines on his stomach. Mattress 6 has an opening 8 near the top through which the patient can observe and use the table of this invention mounted below the patient as shown.

Certain support bars such as 10 are shown but some of the supporting bars and structure of the rotatable bed have been omitted for clarity of presentation. The bed assembly is mounted upon moveable platform 12 having wheels 14. The bed is rotated end-to-end by rotating the bed on rails 2 rolling in guide rolls 15.

The infinitely adjustable table of this invention comprises table surface member 16 having side boards 18 and back board 20 mounted as shown perpendicularly to the table surface, extending around the periphery of table surface 16 and extending above and below table surface 16 to prevent objects from falling from the table surface. Ledge 22 is shown on one side of the table surface extending across the surface to hold a book or the like if desired. The edge of the table adjacent the patient has a covering thereon of plastic tubing 24. The telescoping support members 28 are preferably aluminum tubing, each having an inner tube 30 and an outer sleeve 32. The means shown for fixing the length of the telescoping support 28 comprise a bolt 34 extending through holes in tube 30 and sleeve 32 and being affixed by nut 36. Each brace member 28 is affixed at one end thereof near one corner of the table by means of adjustable securing knobs 40 secured to the table sides 18 by carriage bolts 42. Each support member 28 is affixed at the other end thereof to the desired position on the rails 2 by means of clamps 44.

Figure 2:
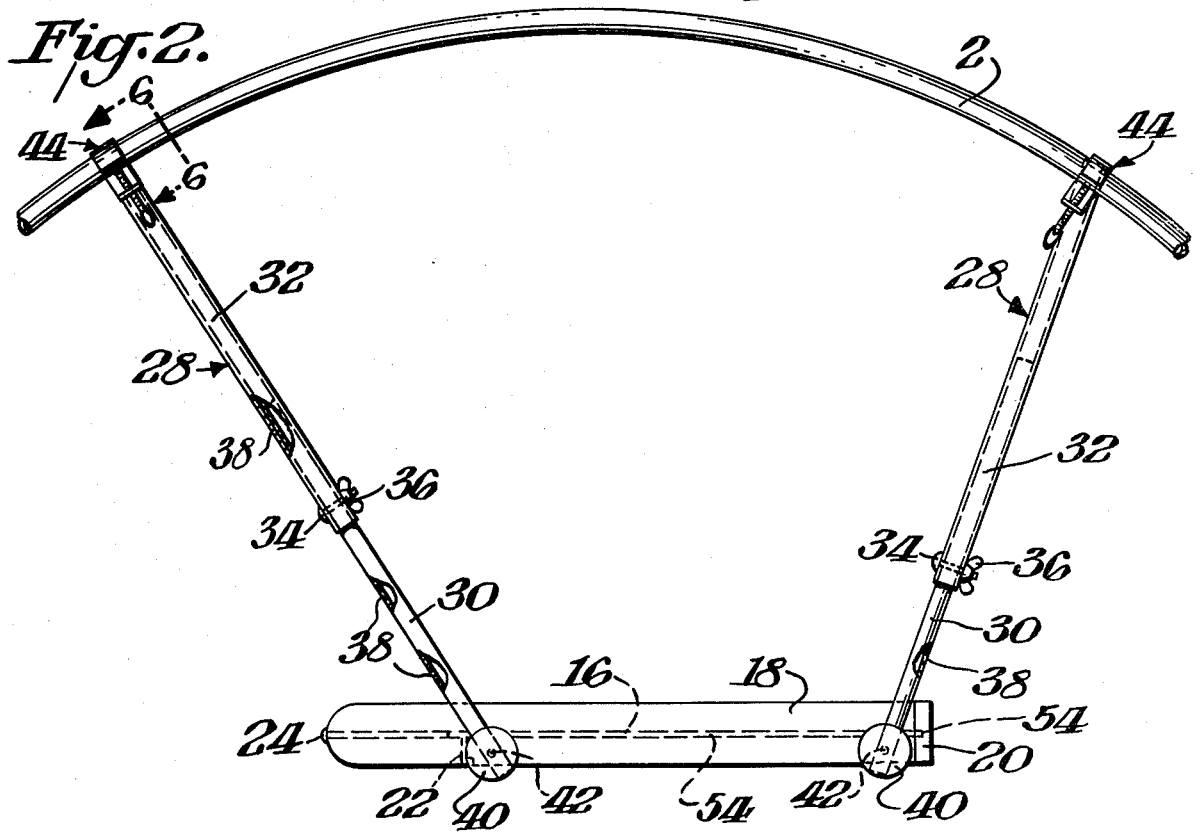
FIG. 2 is a side elevational view, in part cutaway, showing the table of this invention mounted upon the upper rails of the rotatable bed.

FIG. 2 shows the adjustable table of this invention in another one of the virtually infinite number of locations on the rotatable bed. Therein the table is shown hanging from the upper part of the bed rails 2. Table surface 16 extends into daddo grooves 54 in side boards 18 and back board 20, being secured by glueing means or the like therein. Ledge 22 is seen behind adjustable knob 40. Knob 40 and support member 28 are secured to side board 18 by carriage bolt 42. By unscrewing knobs 40 and bolts 50, the table can be adjusted horizontally and secured thereat by tightening knobs 40 and bolts 50. The support members 28 are shown in partial cutaway in FIG. 2 wherein tube 30 and sleeve 32 are shown to have holes 38 through which bolt 34 may be placed and secured by nut 36 at the desired fixed extension of the support 28. Four holes as shown in tube 30 and one hole as shown in sleeve 32 are preferred. Also shown for completeness in FIG. 2 are plastic edging 24 and clamps 44.

Figure 3:
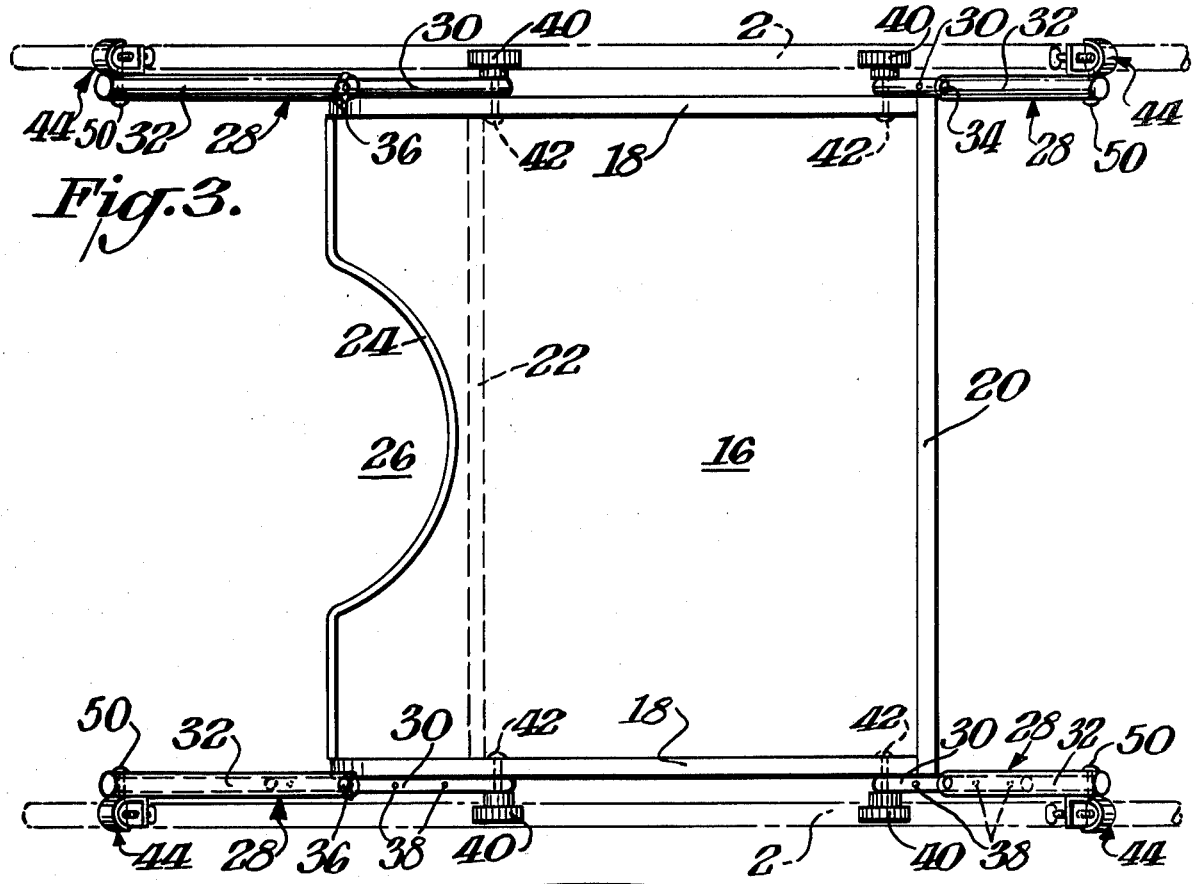
FIG. 3 is a top plan view.

FIG. 3 is a top plan view of the table of this invention. Therein is shown table surface 16 having side boards 18 and back board 20. Ledge 22 is shown on the under side of surface 16. The plastic edging 26 extends along the surface edge adjacent the patient and through the indentation 26. Support members 28 comprising tube 30 and sleeve 32 secure the table to rails 2 by means of clamps 44 and bolts 50. The supports 28 are secured to the table sides 18 by means of adjusting knobs 40 and carriage bolts 42.

Figure 4:
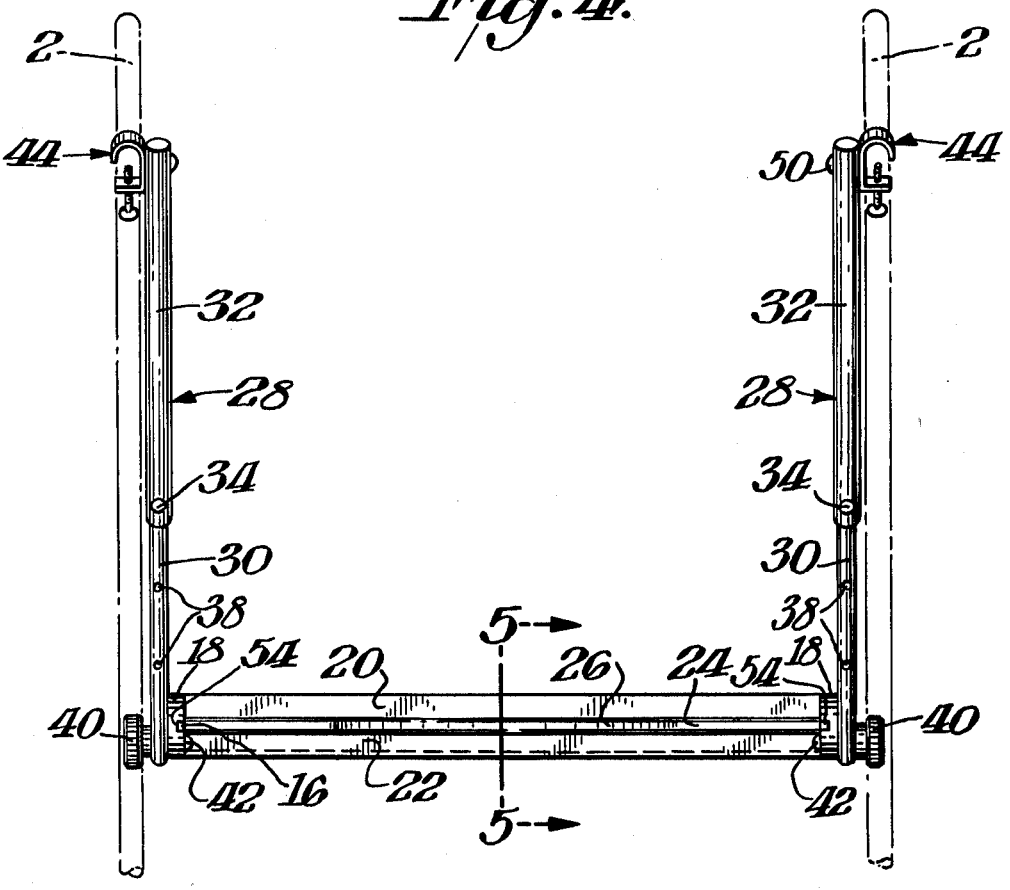
FIG. 4 is a front elevation of the table of this invention.

FIG. 4 is a front elevational view of the table of this invention as seen by a patient reclining on his back in the rotatable bed, the table being affixed to the rails 2 by means of clamps 44, in a manner similar to that shown in FIG. 2. Table surface 16 extends into groove 54 and is secured thereat. Side boards 18 and back board 20 prevent objects from falling from the table, the table being in the position wherein the ledge 22 is on the underside of the table surface and is not being utilized. The tubular support members 28, having tubes 30 and sleeves 32, are shown fixed at the desired extension by means of bolts 34 extending through holes 38 and secured by nuts 36. The indentation 26 and plastic edging are shown for completeness. Adjustable knobs 40 serve to adjust and fix the support members to the table sideboard 18 by means of bolt 42.

Figure 5:
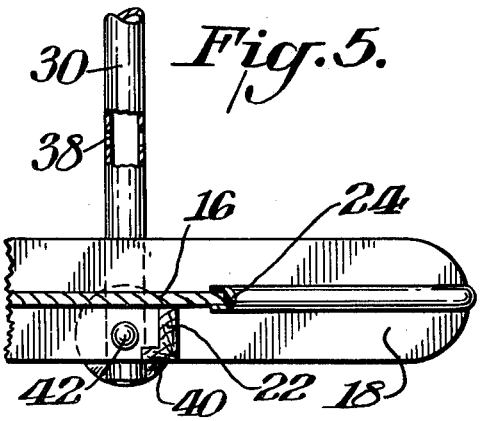
FIG. 5 is a side view, in partial cross-section, taken along the line 5—5 of FIG. 4.

FIG. 5 is taken along line 5—5 of FIG. 4. FIG. 5 shows table surface 16 and plastic edge covering 24. Ledge 22 is extending below the table surface 16 and between sideboards 18. Adjusting knob 40 is also shown, its tightness being determined by adjusting bolt 42. Tube 30 is shown in part cross-section, wherein hole 38 is shown in detail.

Figure 6:
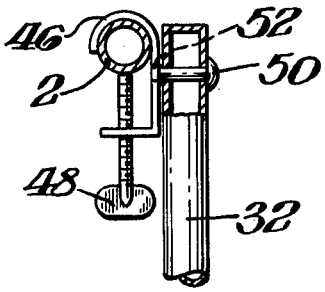
FIG. 6 is a detailed view, in partial cross-section, of preferred clamping means for clamping the table support members to the bed rails, taken along line 6—6 of FIG. 2.

FIG. 6 shows the preferred clamping means. This view is in partial cross-section and is taken along line 6—6 of FIG. 2. The clamp comprises bracket 46, curved at its upper end and adapted to fit over rail 2 and be secured thereto by means of set screw or thumb screw 48. Bracket 46 has a drilled and tapped hole 52 in the side thereof which receives bolt 50 extending through tubular support sleeve 32 and thereby secures the tubular support member to the rails 2.

As can be seen by one skilled in the art, very simple adjustments enable the table of this invention to be fixed at virtually any desired position on a circular hospital bed to accommodate any patient. The table can also conveniently be pushed out of the way without dismantling, if desired.

While the invention herein has been disclosed with reference to certain particular preferred embodiments for illustrative purposes, it will be recognized that variations and modifications of the disclosed apparatus can be made without deviating from the gist of the invention, and such variations and modifications are deemed to fall within the scope of the claims below.

I claim:

1. A versatile table for use in conjunction with an end-to-end rotatable hospital bed and being adjustable to virtually any position above, below or adjacent to a patient using said bed, said table comprising:

(a) a table surface, generally rectangular or square, having adjustably affixed near each corner thereof, (b) a telescoping support member, each telescoping support member having means for adjusting its length and for fixing its length at a desired position, each such support member having at its end opposite said table, (c) adjustable clamping means which can be affixed to the rails or other support bars of said rotatable bed, and having (d) side and back boards affixed to said table surface substantially perpendicular to said surface and extending along the sides and back of said table surface and extending above and below said table surface to keep objects from falling therefrom, and (e) at least one ledge on at least one side thereof to support a book and the like, thereby providing an infinitely adjustable table for use by a patient on said bed.

2. The table of claim 1 having an indentation in the edge thereof located adjacent the patient to provide easy access to objects on said table by the patient.

3. The table of claim 1 having a plastic covering along the edge thereof located adjacent the patient.

4. The table of claim 1 wherein each said telescoping support member comprises an inner tube and an outer sleeve.

5. The table of claim 4 wherein the means for fixing the length of the telescoping support member comprises a bolt extending through openings in said tube and sleeve at a desired position and being affixed thereat by a nut.

6. The table of claim 1 wherein said telescoping support members are adjustably affixed near the corners of said table surface by adjustable securing knobs each secured by a carriage bolt extending through one of said side boards, said support members and into said knobs.

7. The table of claim 1 wherein said adjustable clamping means comprises a shaped bracket extending partially around a bed rail or supporting bar at one end thereof and adapted to receive a set screw at the other end thereof such that when a set screw is in place and tightened the bracket is fixed to said rail, each such clamp being affixed to a respective support member by a carriage bolt extending through the support member and into a tapped and threaded hole in said shaped bracket.

8. The table of claim 1 wherein said table surface is made of wood and said telescoping support members are made of aluminum tubing.

* * * * *